US012203287B2

(12) United States Patent
Spykerman

(10) Patent No.: US 12,203,287 B2
(45) Date of Patent: Jan. 21, 2025

(54) POOL SKIMMER ASSEMBLY WITH SECURABLE SKIMMER BASKET FACILITATED BY RECEIVABLE ENGAGEMENT OF THE SKIMMER BASKET'S HANDLE WITH THE SKIMMER HOUSING AND SUBSEQUENT ROTATION OF THE HANDLE

(71) Applicant: Blue Square Manufacturing, LLC, Chandler, AZ (US)

(72) Inventor: David Spykerman, Chandler, AZ (US)

(73) Assignee: Blue Square Manufacturing, LLC, Chandler, AZ (US)

( * ) Notice: Subject to any disclaimer, the term of this patent is extended or adjusted under 35 U.S.C. 154(b) by 512 days.

(21) Appl. No.: 17/570,518

(22) Filed: Jan. 7, 2022

(65) Prior Publication Data

US 2023/0220694 A1 Jul. 13, 2023

(51) Int. Cl.
*E04H 4/12* (2006.01)

(52) U.S. Cl.
CPC ..... *E04H 4/1272* (2013.01)

(58) Field of Classification Search
None
See application file for complete search history.

(56) References Cited

U.S. PATENT DOCUMENTS 60,337 A * 12/1866 Brown ..... A45C 3/04 220/774
1,488,397 A * 3/1924 Judge et al. ..... B44D 3/122 220/23.88
3,288,192 A * 11/1966 Bollinger ..... F16B 37/041 403/353
3,638,823 A * 2/1972 McCoy ..... A61M 5/1417 294/169
3,765,534 A 10/1973 West et al.
4,365,725 A * 12/1982 Pfeifer ..... B65D 25/32 220/770
4,836,394 A * 6/1989 Glomski ..... E05D 11/1028 220/811
4,913,810 A 4/1990 Hodak
4,976,369 A * 12/1990 Shindo ..... B65D 25/32 220/276
5,150,806 A * 9/1992 Glomski ..... E05D 11/1028 220/908
5,232,796 A * 8/1993 Baumgartner ..... H01M 50/256 429/176

(Continued)

FOREIGN PATENT DOCUMENTS

AU 2014100682 7/2014

*Primary Examiner* — Robert J Popovics
(74) *Attorney, Agent, or Firm* — Miller Johnson

(57) ABSTRACT

A skimmer assembly includes a basket assembly and a housing. The basket assembly includes a basket and a handle rotatably coupled to the basket. The handle includes a first end extending outwardly from the basket and configured to rotate between a first orientation and a second orientation about an axis of rotation. The axis of rotation extends in a first direction. The housing includes an upper chamber, a lower chamber, and a wall disposed between the upper chamber and the lower chamber. The wall includes an aperture defined in part by opposed lateral walls configured to inhibit translation of the basket assembly in a direction transverse to the first direction when the first end is in the first orientation.

20 Claims, 5 Drawing Sheets

(56) References Cited

U.S. PATENT DOCUMENTS 5,356,027 A * 10/1994 Craft ..... B65F 1/1646 16/272
5,445,425 A * 8/1995 Lyver ..... B44D 3/12 220/762
5,816,439 A * 10/1998 Lovell ..... B65D 25/32 220/761
6,352,169 B2 * 3/2002 Foster ..... A47J 45/07 220/773
6,494,341 B2 * 12/2002 Perkins ..... B65D 25/32 220/760
7,451,500 B2 11/2008 Baker, Jr. et al.
7,780,036 B2 * 8/2010 Splain ..... A45C 13/26 206/505
7,914,009 B1 3/2011 Gerspach
8,273,145 B2 * 9/2012 Banks ..... B01D 46/001 55/482
9,555,930 B2 * 1/2017 Campbell ..... B44D 3/12
D819,971 S * 6/2018 Lindsay ..... D3/312
10,161,151 B2 12/2018 Goettl et al.
10,173,808 B2 * 1/2019 Lee, Jr. ..... A47J 45/065
10,472,130 B2 * 11/2019 Foster ..... B65D 25/32
10,835,846 B1 11/2020 Carpenter
11,059,625 B2 * 7/2021 Sofy ..... B62B 1/12
11,331,616 B2 * 5/2022 Henderson ..... C02F 1/004
11,332,951 B2 * 5/2022 Jackson ..... B01D 29/27
11,524,252 B2 * 12/2022 Aquilina ..... E04H 4/1272
11,976,490 B2 * 5/2024 Owens ..... E04H 4/1272
12,076,667 B2 * 9/2024 Renken ..... E04H 4/1272
2006/0289711 A1 * 12/2006 Wilschut ..... B65D 1/24 248/309.1
2007/0062960 A1 * 3/2007 Splain ..... A45C 13/26 220/669
2012/0060454 A1 * 3/2012 Banks ..... B01D 46/4227 55/493
2017/0184233 A1 6/2017 Beagen, Jr.
2021/0017782 A1 * 1/2021 Jackson ..... B01D 39/10
2021/0039022 A1 * 2/2021 Aquilina ..... E04H 4/1272
2021/0131132 A1 5/2021 Blanc Tailleur et al.
2021/0283534 A1 * 9/2021 Renken ..... B01D 29/35
2022/0258091 A1 * 8/2022 Henderson ..... B01D 29/21
2023/0108937 A1 * 4/2023 Perez ..... B01D 35/02 210/167.1
2023/0220693 A1 * 7/2023 Owens ..... C02F 1/40 210/167.1
2023/0220694 A1 * 7/2023 Spykerman ..... E04H 4/1272 210/167.19
2023/0220695 A1 * 7/2023 Owens ..... E04H 4/1272 222/1

* cited by examiner

POOL SKIMMER ASSEMBLY WITH SECURABLE SKIMMER BASKET FACILITATED BY RECEIVABLE ENGAGEMENT OF THE SKIMMER BASKET'S HANDLE WITH THE SKIMMER HOUSING AND SUBSEQUENT ROTATION OF THE HANDLE

TECHNICAL FIELD

This disclosure relates generally to a skimmer assembly, and more particularly to a skimmer assembly including a lockable basket for use with a swimming pool.

BACKGROUND

This section provides background information related to the present disclosure and is not necessarily prior art. Conventional swimming pools usually include a skimmer assembly for allowing movement of water from the pool into the skimmer assembly. The skimmer assembly often includes an inlet to a filtration system that is powered by an in-line filter pump. Most skimmer assemblies also include a basket to capture leaves, sticks, and other debris as water moves from the pool into the skimmer assembly, and prior to it moving into the filtration system. A weight or other device is often used to secure the position of the basket relative to the rest of the skimmer assembly, thereby ensuring that the basket functions properly in removing debris from the moving water.

While known skimmer assemblies and baskets for skimmer assemblies have proven acceptable for their intended purposes, there remains a continuous need for improvement in the relevant art.

SUMMARY

This section provides a general summary of the disclosure, and is not a comprehensive disclosure of its full scope or all of its features.

One aspect of the disclosure provides a skimmer assembly. The skimmer assembly includes a basket assembly and a housing. The basket assembly includes a basket and a handle rotatably coupled to the basket. The handle includes a first end extending outwardly from the basket and configured to rotate between a first orientation and a second orientation about an axis of rotation. The axis of rotation extends in a first direction. The housing includes an upper chamber, a lower chamber, and a wall disposed between the upper chamber and the lower chamber. The wall includes an aperture defined in part by opposed lateral walls configured to inhibit translation of the basket assembly in a direction transverse to the first direction when the first end is in the first orientation.

Implementations of the disclosure may include one or more of the following optional features. In some implementations, the opposed laterals walls include a first lateral wall and a second lateral wall. The first lateral wall may include a first upper surface and a first lower surface. The second lateral wall may include a second upper surface and a second lower surface. The first upper surface and the second upper surface may define a first distance therebetween. The first lower surface and the second lower surface may define a second distance therebetween. The first distance may be less than the second distance.

The skimmer assembly may further include a first intermediate surface and a second intermediate surface. The first intermediate surface may extend from the first upper surface to the first lower surface. The second intermediate surface may extend from the second upper surface to the second lower surface. The first end may be configured to engage at least one of the first intermediate surface or the second intermediate surface in the first orientation. The first end may be configured to rotate from the first orientation to the second orientation between the first lower surface and the second lower surface. The first end may be configured to translate between the first upper surface and the second upper surface in the second orientation.

In some implementations, the wall includes an upper surface and a side surface extending transversely from the upper surface. The first upper surface and the second upper surface may at least partially define a first opening in the upper surface and a second opening in the side surface. The first lower surface and the second lower surface may at least partially define the first opening and the second opening.

In some implementations, the basket includes an upper rim. The first end may extend through the upper rim. The wall may be configured to face the upper rim in the first orientation and the second orientation. The wall may include an upper surface. The upper rim may be flush with, or recessed relative to, the upper surface in the first orientation and the second orientation.

In some implementations, the first end defines an oblong shape having a major cross-sectional axis. The axis of rotation may be offset from a center of the major cross-sectional axis.

Another aspect of the disclosure provides a skimmer assembly. The skimmer assembly includes a basket assembly and a housing. The basket assembly includes a basket and a handle coupled to the basket for rotation about an axis of rotation. The handle includes a first end extending outwardly from the basket. The housing includes a chamber defined at least in part by a wall including an upper surface, a side surface, a first lateral wall, and a second lateral wall. The first and second lateral walls form a first opening in the upper surface and a second opening in the side surface. The first and second lateral walls define a first distance therebetween at a first location and a second distance therebetween at a second location offset from the first location. The first end is operable to rotate about the axis of rotation by a first angle at the first location. The first end is inhibited from rotating about the axis of rotation by the first angle at the second location.

This aspect may include one or more of the following optional features. In some implementations, the axis of rotation extends in a first direction. The first and second lateral walls may be configured to inhibit translation of the basket assembly in a direction transverse to the first direction.

In some implementations, the second location is disposed between the upper surface and the first location.

In some implementations, the first lateral wall includes a first upper surface and a first lower surface. The second lateral wall may include a second upper surface and a second lower surface. The first upper surface and the second upper surface may define the second distance therebetween. The first lower surface and the second lower surface may define the second distance therebetween.

In some implementations, the first lateral wall includes a first intermediate surface and the second lateral wall includes a second intermediate surface. The first intermediate surface may extend from the first upper surface to the first lower surface. The second intermediate surface may extend from the second upper surface to the second lower surface. The first and second intermediate surfaces may define a third distance therebetween. The third distance may be less than the first distance and greater than the second distance.

In some implementations, the first upper surface and the second upper surface extend from the upper surface. The first lower surface may extend from the first upper surface. The second lower surface may extend from the second upper surface. The first end may be configured to translate between the first upper surface and the second upper surface.

In some implementations, the basket includes an upper rim. The first end may extend through the upper rim. The side surface may be configured to face the upper rim. The upper rim may be flush with, or recessed relative to, the upper surface in an assembled configuration.

In some implementations, the first end defines an oblong shape having a major cross-sectional axis. The axis of rotation may be offset from a center of the major cross-sectional axis.

The details of one or more implementations of the disclosure are set forth in the accompanying drawings and the description below. Other aspects, features, and advantages will be apparent from the description and drawings, and from the claims.

DESCRIPTION OF DRAWINGS

The drawings described herein are for illustrative purposes only of selected configurations and not all possible implementations, and are not intended to limit the scope of the present disclosure.

Like reference symbols in the various drawings indicate like elements.

DETAILED DESCRIPTION

Figure 1:
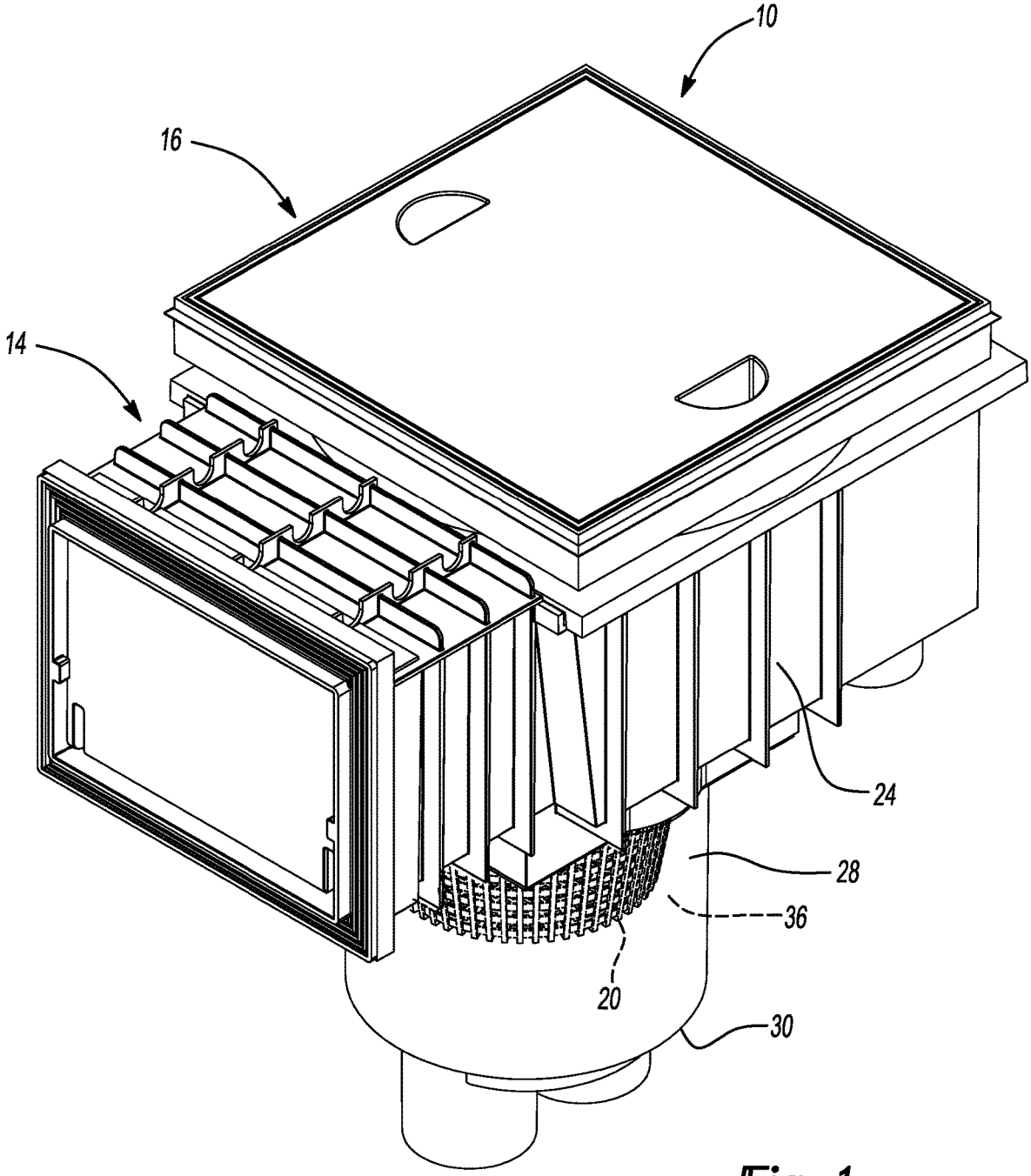
FIG. 1 is a perspective view of a skimmer assembly including a basket in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Referring to FIG. 1, a skimmer assembly 10 is shown. As will be explained in more detail below, the skimmer assembly 10 may be utilized with, or assembled with, a swimming pool construct (not shown) in order to perform various functions relative to the water in the pool construct. For example, as will be described in more detail below, the skimmer assembly 10 maybe used to fill, chlorinate, remove debris, or perform other maintenance-related functions relative to the water in the pool construct.

The skimmer assembly 10 may include a housing assembly 14 and a cover assembly 16. In an assembled configuration, the cover assembly 16 may be coupled to the housing assembly 14, such that removing the cover assembly 16 from the housing assembly 14 allows a user to access various components within the housing assembly 14.

Figure 2:
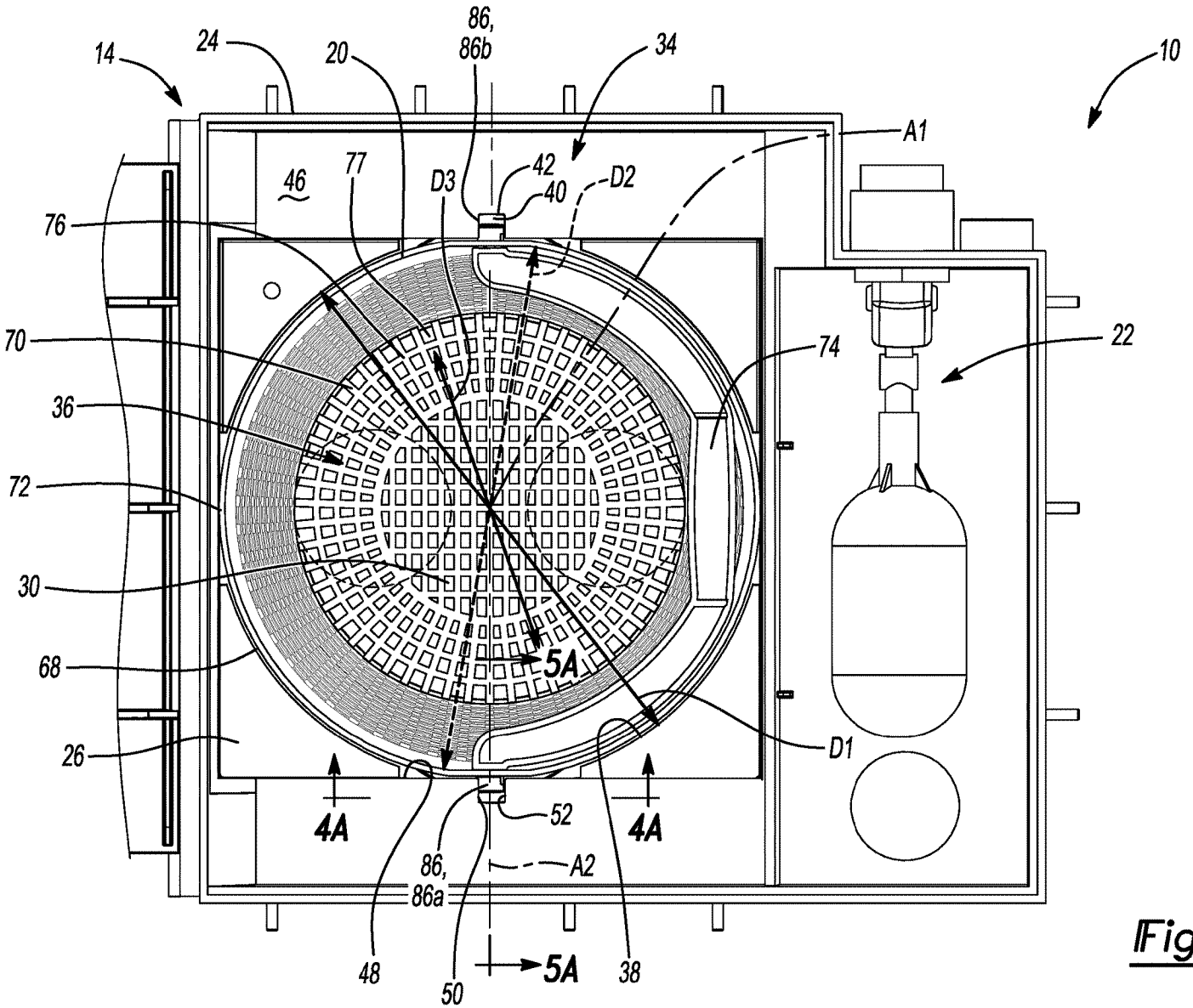
FIG. 2 is a top view of a portion of the skimmer assembly of FIG. 1 in accordance with the principles of the present disclosure. For clarity, a cover of the skimmer assembly is removed from FIG. 2.
Figure 3:
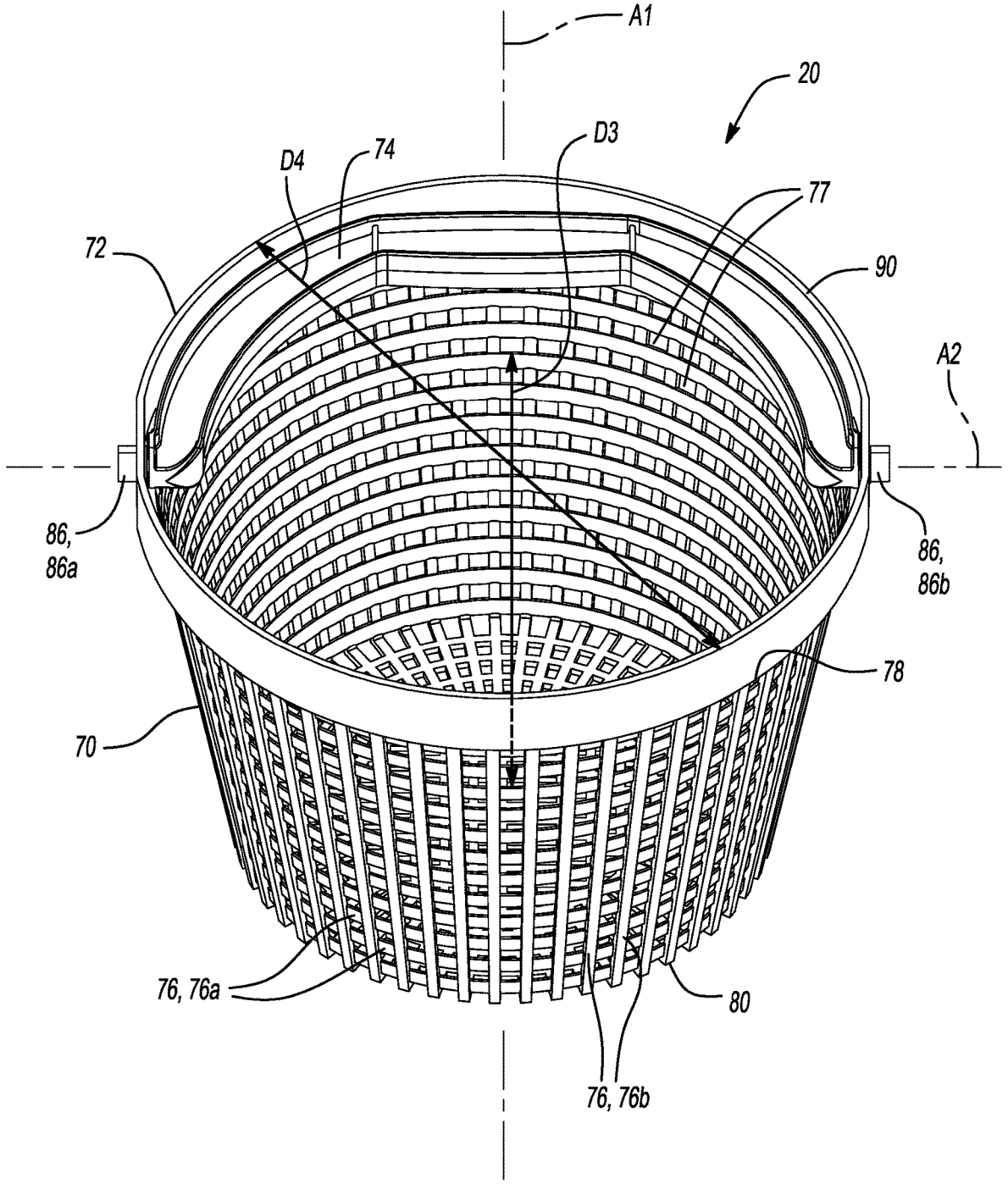
FIG. 3 is a perspective view of the basket of the skimmer assembly of FIG. 1.

As illustrated in FIG. 2, the housing assembly 14 may include a housing 18, a basket assembly 20, and a valve assembly 22. The housing 18 may include one or more upper sidewalls 24, a base wall 26, one or more lower sidewalls 28, and a lower wall 30. The upper sidewalls 24 and the base wall 26 may collectively define at least a portion of an upper chamber 34. The lower sidewalls 28 and the lower wall 30 may collectively define at least a portion of a lower chamber 36 in fluid communication with the upper chamber 34.

The base wall 26 may define an opening 38 in fluid communication with the upper and lower chambers 34, 36. In some implementations, the opening 38 defines a substantially circular shape having a first cross-sectional dimension (e.g., diameter D1). The opening 38 may be further defined in part by one or more apertures 40 formed in the base wall 26. As illustrated in FIG. 2, in some implementations, the housing 18 includes two apertures 40 disposed on opposed sides of the housing 18.

The apertures 40 may define and/or form a first opening 42 in fluid communication with the upper chamber 34, and a second opening 44 in fluid communication with the lower chamber 36. In this regard, the first opening 42 may be formed in an upper surface 46 of the base wall 26, while the second opening 44 may be formed in a side surface 48 of the base wall 26. The upper surface 46 may extend transversely (e.g., orthogonal) from the side surface 48. The opening 38 may be defined in part by a first lateral wall 50 and a second lateral wall 52 facing the first lateral wall 50. The first and second lateral walls 50, 52 may each include an upper surface 54, 56, respectively, a lower surface 58, 60, respectively, and an intermediate surface 62, 64, respectively.

The upper surfaces 54, 56 may extend between the intermediate surfaces 62, 64, respectively, and the surface 46 of the base wall 26 and define a first distance X1 therebetween. The lower surfaces 58, 60 may extend from the intermediate surfaces 62, 64 and define a second distance X2 therebetween. The first distance X1 may be smaller than the second distance X2 such that the intermediate surfaces 62, 64 define both the first distance X1 and the second distance X2. In this regard, in some implementations the intermediate surfaces 62, 64 form a ramped surface extending from the upper surfaces 54, 56 to the lower surfaces 58, 60.

The housing 18 may further include a stepped ledge 68 disposed between the lower chamber 36 and the upper surface 46 of the base wall 26. In some implementations, the ledge 68 is formed by an end of the lower sidewalls 28. In this regard, the ledge 68 may define a second cross-sectional dimension (e.g., diameter D2). A smallest extent of the first cross-sectional dimension D1 may be larger than a smallest extent of the second cross-sectional dimension D2.

Referring to FIGS. 2-5B, the basket assembly 20 may include a basket 70, a rim 72, and a handle 74. The basket 70 may include a plurality of strips 76 of material extending in various directions to define a plurality of apertures 77 therebetween. In this regard, the strips 76 of material may include laterally-extending strips 76*a* and longitudinally-extending strips 76*b* that collectively form a mesh construct. The laterally-extending strips 76*a* surround a central axis A1 of the basket 70. In some implementations, a length of each laterally-extending strip 76*a* is shorter than an adjacent laterally-extending strip 76*a* in a direction extending from a top 78 of the basket 70 toward a bottom 80 of the basket, such that a cross-sectional dimension (e.g., diameter D3) of the basket 70 is progressively smaller in a direction extending from the top 78 toward the bottom 80.

The rim 72 may be disposed adjacent the top 78 of the basket. In some implementations, the rim 72 surrounds the central axis A1 and defines an outermost cross-sectional dimension (e.g., diameter D4) that is greater than the value of the largest outermost cross-section dimension (e.g., diameter D3) of the basket 70. In this regard, the dimensions D3 and D4 may be sized such that the basket 70 and rim 72 are received by the opening 38, while the rim 72 engages, and is supported by, the stepped ledge 68. In this regard, the dimension D4 may be greater dimension D2, while the largest value of the dimension D3 may be smaller than the dimension D2. In some implementations, the basket assembly 20 (e.g., the rim 72) defines at least one aperture 84 sized to receive a portion of the handle 74. For example, the rim 72 may define a pair of opposed apertures 84 sized to receive opposed ends of the handle 74.

The handle 74 may be rotatably coupled to a remaining portion of the basket assembly 20. For example, the handle 74 may be rotatably coupled to the rim 72. In particular, the handle 74 may include at least one end 86 extending through one of the apertures 84. In some implementations, the handle 74 includes opposed ends 86*a*, 86*b* each extending through one of the apertures 84. The ends 86*a*, 86*b* may be rotatably received within the apertures 84 such that, upon rotation of the handle 74 relative to the basket 70, the ends 86*a*, 86*b* rotate within the apertures 84.

Figure 4A:
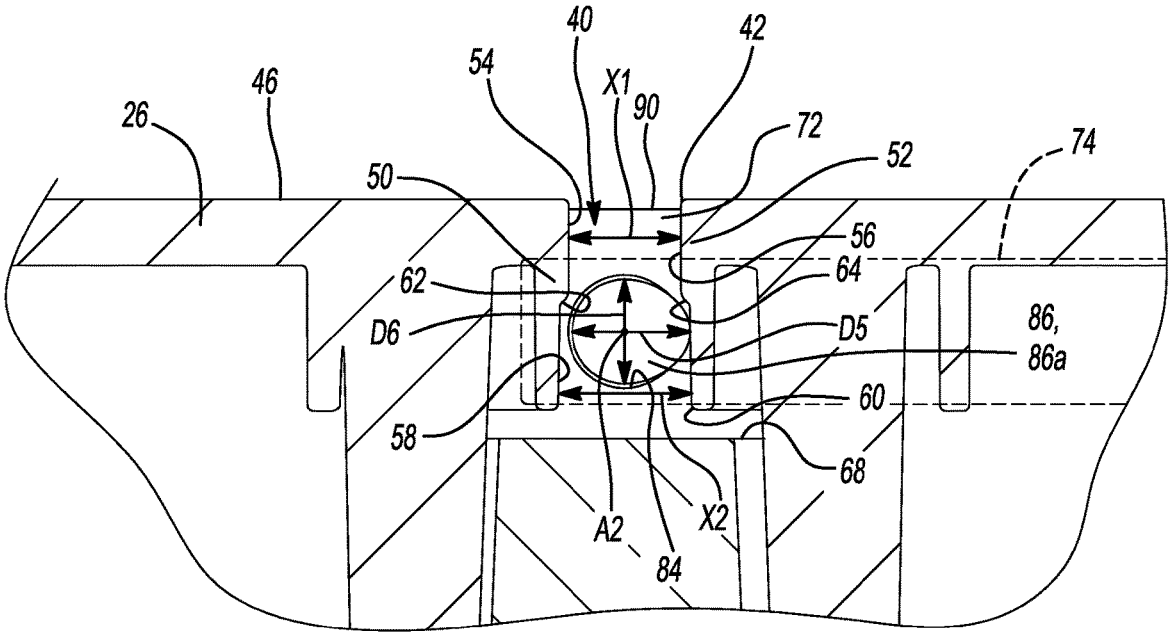
FIG. 4A is a cross-sectional view of a portion of the skimmer assembly of FIG. 1 taken through the line 4A-4A of FIG. 2 with a handle of the basket in a first orientation.
Figure 4B:
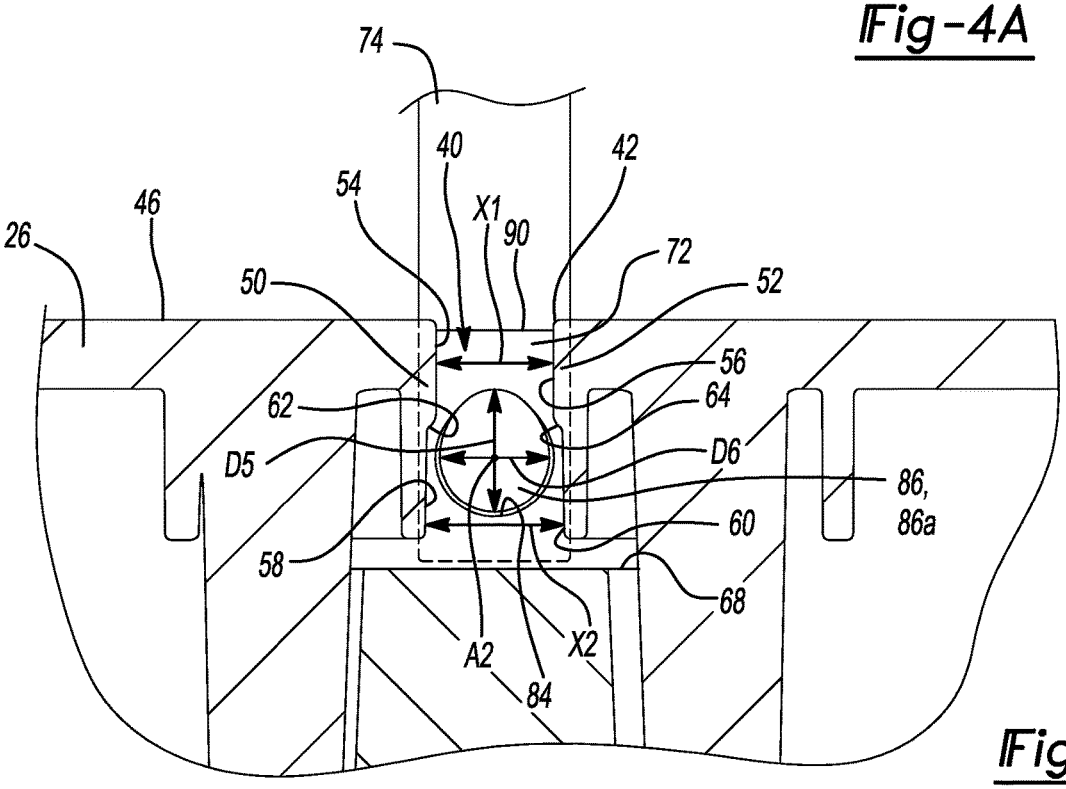
FIG. 4B is a cross-sectional view of a portion of the skimmer assembly of FIG. 1 taken through the line 4A-4A of FIG. 2 with a handle of the basket in a second orientation.
Figure 5B:
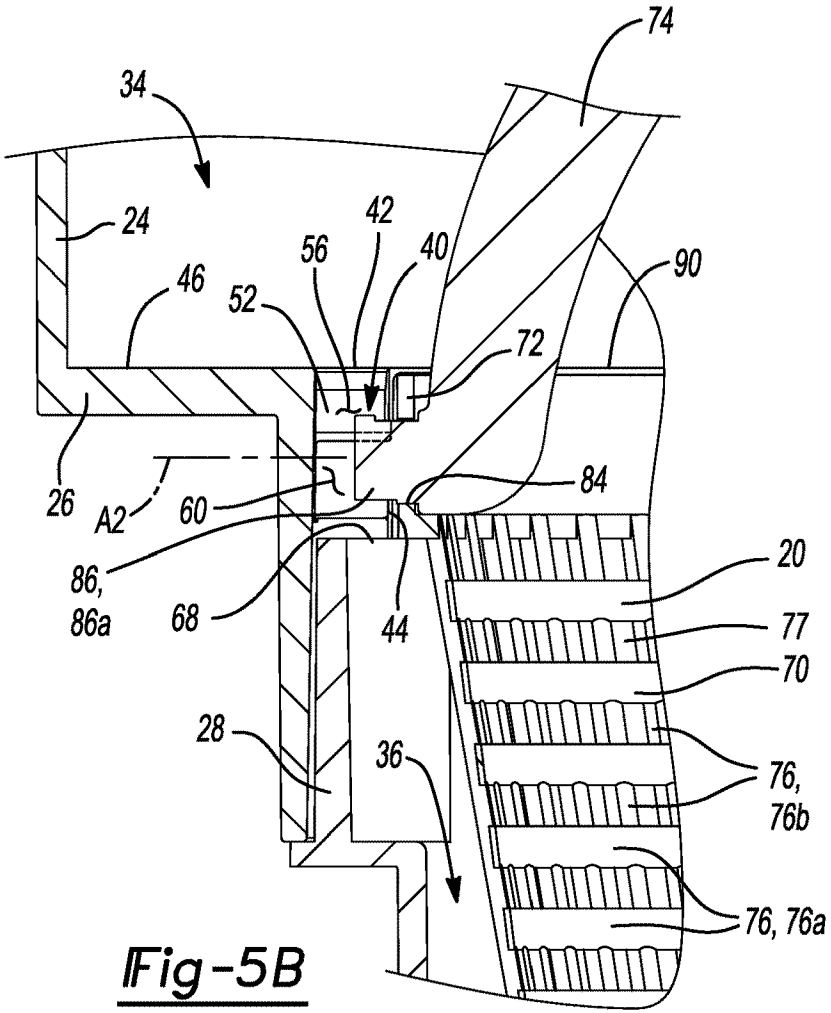
FIG. 5B is a cross-sectional view of a portion of the skimmer assembly of FIG. 1 taken through the line 5A-5A of FIG. 2 with a handle of the basket in a second orientation.
Figure 5A:
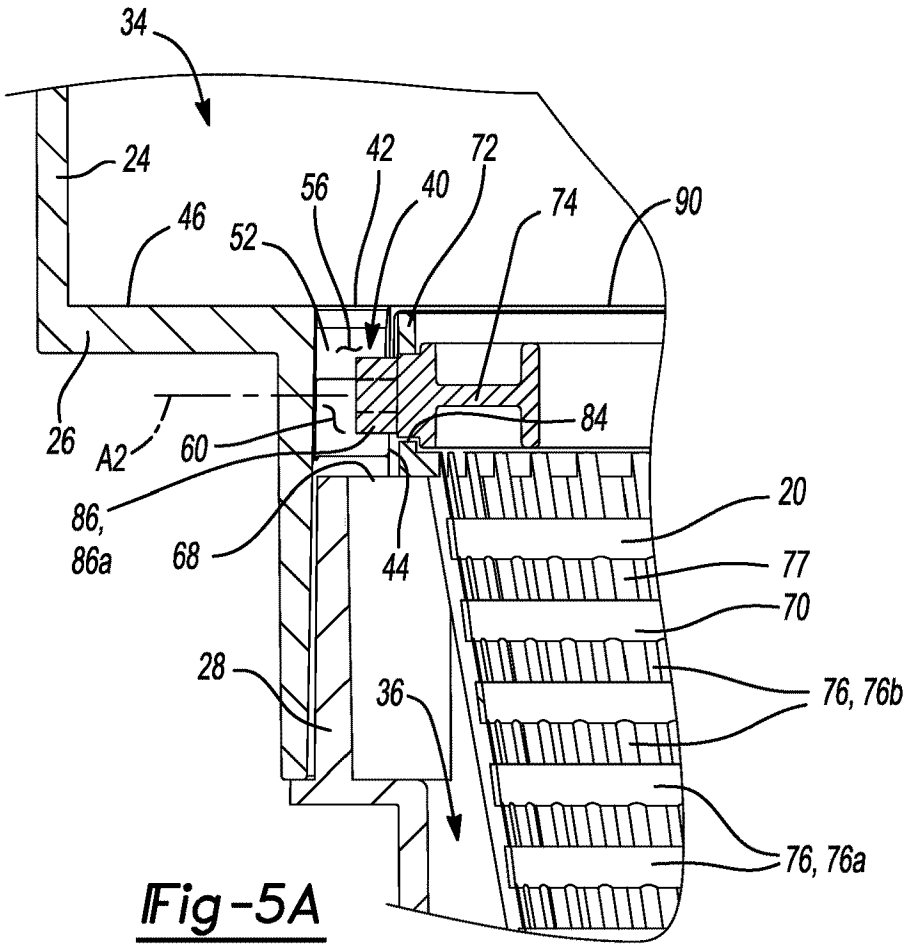
FIG. 5A is a cross-sectional view of a portion of the skimmer assembly of FIG. 1 taken through the line 5A-5A of FIG. 2 with a handle of the basket in a first orientation.

With particular reference to FIGS. 4A and 4B, the ends 86*a*, 86*b* may form an oblong shape (e.g., teardrop, pear-shape) defining a major cross-sectional axis D5 and a minor cross-sectional axis D6. The major and minor cross-sectional axes D5, D6 may extend through an axis of rotation A2 of the handle 74. The length of the major cross-sectional axis D5 may be greater than the length of the minor cross-sectional axis D6. In this regard, the axis of rotation A2 may be offset (e.g., eccentric) from a center of the major cross-sectional axis D5 such that the ends 86*a*, 86*b* form a pear-shaped cam.

In some implementations, the length of the minor cross-sectional axis D6 is less than the length of the dimension X1 and the length of the dimension X2, while the length of the major cross-sectional axis D5 may be greater than the length of the dimension X1 and less than the length of the dimension X2. Accordingly, rotation of the handle 74 from a first position (e.g., FIGS. 2, 3, 4A, and 5A) to a second position (e.g., FIGS. 4B and 5B), may allow a user to remove the ends 86*a*, 86*b* from the apertures 40 and, thereafter, remove the basket assembly 20 from the housing assembly 14, as will be described in more detail below. Conversely, when the handle 74 is in the first position, the intermediate surface(s) 62, 64 may engage the end(s) 86*a*, 86*b* to prevent the user from removing the ends 86*b*, 86*b* from the apertures 40 and thereby prevent the user from removing the basket assembly 20 from the housing assembly 14.

A method of operating the skimmer assembly 10 will now be described with reference to FIGS. 4A-5B. In a step of operating the skimmer assembly 10, a user may rotate the handle 74 relative to the basket 70 such that the axis D5 extends in a direction substantially (e.g., +/−forty-five degrees) parallel to the axis A1 of the basket 70.

In another step of operating the skimmer assembly 10, the user may position the basket assembly 20 within the housing assembly 14. In particular, the user may position the basket 70 within the lower chamber 36, such that the ends 86*a*, 86*b* translate between the upper surfaces 54, 56 and the intermediate surfaces 62, 64 until the ends 86*a*, 86*b* are disposed between the lower surfaces 58, 60. In the stowed position of the basket assembly 20, the rim 72 may be supported by the stepped ledge 68 such that an uppermost edge 90 of the rim 72 is substantially coplanar with, or recessed relative to, the upper surface 46 of the base wall 26.

In another step of operating the skimmer assembly 10, the user may rotate the handle 74 about the axis A2 by an angle (e.g., ninety degrees+/−forty-five degrees) until the axis D5 extends in a direction substantially (e.g., +/−forty-five degrees) perpendicular to the axis A1 and/or the axis D6 extends in a direction substantially (e.g., +/−forty-five degrees) parallel to the axis A1. After rotation of the handle 74 about the axis A2 into the stowed position (e.g., FIGS. 4A and 5A), a force applied on the basket assembly 20 in a direction of the axis A2 may cause the end(s) 86*a*, 86*b* to engage the intermediate surface(s) 62, 64, thereby preventing removal of the basket assembly 20 from the housing 14.

The following Clauses provide an exemplary configuration for a skimmer assembly and related methods, as described above.

Clause 1: A skimmer assembly comprising: a basket assembly including a basket and a handle rotatably coupled to the basket, the handle including a first end extending outwardly from the basket and configured to rotate between a first orientation and a second orientation about an axis of rotation extending in a first direction; and a housing including an upper chamber, a lower chamber, and a wall disposed between the upper chamber and the lower chamber, the wall including an aperture defined in part by opposed lateral walls configured to inhibit translation of the basket assembly in a direction transverse to the first direction when the first end is in the first orientation.

Clause 2: The skimmer assembly of clause 1, wherein the opposed laterals walls include a first lateral wall and a second lateral wall, the first lateral wall including a first upper surface and a first lower surface, the second lateral wall including a second upper surface and a second lower surface, the first upper surface and the second upper surface defining a first distance therebetween, the first lower surface and the second lower surface defining a second distance therebetween, the first distance being less than the second distance.

Clause 3: The skimmer assembly of clause 2, further comprising a first intermediate surface and a second intermediate surface, the first intermediate surface extending from the first upper surface to the first lower surface, the second intermediate surface extending from the second upper surface to the second lower surface, wherein the first end is configured to engage at least one of the first intermediate surface or the second intermediate surface in the first orientation.

Clause 4: The skimmer assembly of any of clauses 2 through 3, wherein the first end is configured to rotate from the first orientation to the second orientation between the first lower surface and the second lower surface.

Clause 5: The skimmer assembly of any of clauses 2 through 4, wherein the first end is configured to translate between the first upper surface and the second upper surface in the second orientation.

Clause 6: The skimmer assembly of any of clauses 2 through 5, wherein: the wall includes an upper surface and a side surface extending transversely from the upper surface, the first upper surface and the second upper surface at least partially define a first opening in the upper surface and a second opening in the side surface; and the first lower surface and the second lower surface at least partially define the first opening and the second opening.

Clause 7: The skimmer assembly of any of clauses 1 through 6, wherein: the basket includes an upper rim; the first end extends through the upper rim; and the wall is configured to face the upper rim in the first orientation and the second orientation.

Clause 8: The skimmer assembly of clause 7, wherein the wall includes an upper surface, and wherein the upper rim is flush with, or recessed relative to, the upper surface in the first orientation and the second orientation.

Clause 9: The skimmer assembly of any of clauses 1 through 8, wherein the first end defines an oblong shape having a major cross-sectional axis.

Clause 10: The skimmer assembly of clause 9, wherein the axis of rotation is offset from a center of the major cross-sectional axis.

Clause 11: A skimmer assembly comprising: a basket assembly including a basket and a handle coupled to the basket for rotation about an axis of rotation, the handle including a first end extending outwardly from the basket; and a housing including a chamber defined at least in part by a wall including an upper surface, a side surface, a first lateral wall, and a second lateral wall, the first and second lateral walls forming a first opening in the upper surface and a second opening in the side surface, the first and second lateral walls defining a first distance therebetween at a first location and a second distance therebetween at a second location offset from the first location, the first end operable to rotate about the axis of rotation by a first angle at the first location, the first end inhibited from rotating about the axis of rotation by the first angle at the second location.

Clause 12: The skimmer assembly of clause 11, wherein the axis of rotation extends in a first direction, and wherein the first and second lateral walls are configured to inhibit translation of the basket assembly in a direction transverse to the first direction.

Clause 13: The skimmer assembly of any of clauses 11 through 12, wherein the second location is disposed between the upper surface and the first location.

Clause 14: The skimmer assembly of any of clauses 11 through 13, wherein: the first lateral wall includes a first upper surface and a first lower surface, and the second lateral wall includes a second upper surface and a second lower surface, the first upper surface and the second upper surface defining the second distance therebetween, the first lower surface and the second lower surface defining the second distance therebetween.

Clause 15: The skimmer assembly of clause 14, wherein the first lateral wall includes a first intermediate surface and the second lateral wall includes a second intermediate surface, the first intermediate surface extending from the first upper surface to the first lower surface, the second intermediate surface extending from the second upper surface to the second lower surface, the first and second intermediate surfaces defining a third distance therebetween, the third distance being less than the first distance and greater than the second distance.

Clause 16: The skimmer assembly of any of clauses 14 through 15, wherein: the first upper surface and the second upper surface extend from the upper surface, the first lower surface extends from the first upper surface, and the second lower surface extends from the second upper surface.

Clause 17: The skimmer assembly of clause 16, wherein the first end is configured to translate between the first upper surface and the second upper surface.

Clause 18: The skimmer assembly of any of clauses 11 through 17, wherein: the basket includes an upper rim; the first end extends through the upper rim; and the side surface is configured to face the upper rim.

Clause 19: The skimmer assembly of clause 18, wherein the upper rim is flush with, or recessed relative to, the upper surface in an assembled configuration.

Clause 20: The skimmer assembly of any of clauses 11 through 19, wherein the first end defines an oblong shape having a major cross-sectional axis, and wherein the axis of rotation is offset from a center of the major cross-sectional axis.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A skimmer assembly comprising:

a basket assembly including a basket and a handle rotatably coupled to the basket, the handle including a first end extending outwardly from the basket and configured to rotate between a first orientation and a second orientation about an axis of rotation extending in a first direction; and a housing including an upper chamber, a lower chamber, and a wall disposed between the upper chamber and the lower chamber, the wall including an aperture defined in part by opposed lateral walls configured to inhibit translation of the basket assembly in a direction transverse to the first direction when the first end is in the first orientation.

2. The skimmer assembly of claim 1, wherein the opposed laterals walls include a first lateral wall and a second lateral wall, the first lateral wall including a first upper surface and a first lower surface, the second lateral wall including a second upper surface and a second lower surface, the first upper surface and the second upper surface defining a first distance therebetween, the first lower surface and the second lower surface defining a second distance therebetween, the first distance being less than the second distance.

3. The skimmer assembly of claim 2, further comprising a first intermediate surface and a second intermediate surface, the first intermediate surface extending from the first upper surface to the first lower surface, the second intermediate surface extending from the second upper surface to the second lower surface, wherein the first end is configured to engage at least one of the first intermediate surface or the second intermediate surface in the first orientation.

4. The skimmer assembly of claim 2, wherein the first end is configured to rotate from the first orientation to the second orientation between the first lower surface and the second lower surface.

5. The skimmer assembly of claim 2, wherein the first end is configured to translate between the first upper surface and the second upper surface in the second orientation.

6. The skimmer assembly of claim 2, wherein:

the wall includes an upper surface and a side surface extending transversely from the upper surface, the first upper surface and the second upper surface at least partially define a first opening in the upper surface and a second opening in the side surface; and the first lower surface and the second lower surface at least partially define the first opening and the second opening.

7. The skimmer assembly of claim 1, wherein:

the basket includes an upper rim;

the first end extends through the upper rim; and the wall is configured to face the upper rim in the first orientation and the second orientation.

8. The skimmer assembly of claim 7, wherein the wall includes an upper surface, and wherein the upper rim is flush with, or recessed relative to, the upper surface in the first orientation and the second orientation.

9. The skimmer assembly of claim 1, wherein the first end defines an oblong shape having a major cross-sectional axis.

10. The skimmer assembly of claim 9, wherein the axis of rotation is offset from a center of the major cross-sectional axis.

11. A skimmer assembly comprising:

a basket assembly including a basket and a handle coupled to the basket for rotation about an axis of rotation, the handle including a first end extending outwardly from the basket; and a housing including a chamber defined at least in part by a wall including an upper surface, a side surface, a first lateral wall, and a second lateral wall, the first and second lateral walls forming a first opening in the upper surface and a second opening in the side surface, the first and second lateral walls defining a first distance therebetween at a first location and a second distance therebetween at a second location offset from the first location, the first end operable to rotate about the axis of rotation by a first angle at the first location, the first end inhibited from rotating about the axis of rotation by the first angle at the second location.

12. The skimmer assembly of claim 11, wherein the axis of rotation extends in a first direction, and wherein the first and second lateral walls are configured to inhibit translation of the basket assembly in a direction transverse to the first direction.

13. The skimmer assembly of claim 11, wherein the second location is disposed between the upper surface and the first location.

14. The skimmer assembly of claim 11, wherein:

the first lateral wall includes a first upper surface and a first lower surface, and the second lateral wall includes a second upper surface and a second lower surface, the first upper surface and the second upper surface defining the second distance therebetween, the first lower surface and the second lower surface defining the second distance therebetween.

15. The skimmer assembly of claim 14, wherein the first lateral wall includes a first intermediate surface and the second lateral wall includes a second intermediate surface, the first intermediate surface extending from the first upper surface to the first lower surface, the second intermediate surface extending from the second upper surface to the second lower surface, the first and second intermediate surfaces defining a third distance therebetween, the third distance being less than the first distance and greater than the second distance.

16. The skimmer assembly of claim 14, wherein:

the first upper surface and the second upper surface extend from the upper surface, the first lower surface extends from the first upper surface, and the second lower surface extends from the second upper surface.

17. The skimmer assembly of claim 16, wherein the first end is configured to translate between the first upper surface and the second upper surface.

18. The skimmer assembly of claim 11, wherein:

the basket includes an upper rim;

the first end extends through the upper rim; and the side surface is configured to face the upper rim.

19. The skimmer assembly of claim 18, wherein the upper rim is flush with, or recessed relative to, the upper surface in an assembled configuration.

20. The skimmer assembly of claim 11, wherein the first end defines an oblong shape having a major cross-sectional axis, and wherein the axis of rotation is offset from a center of the major cross-sectional axis.

* * * * *